US009226864B2

(12) United States Patent
Gianfagna et al.

(10) Patent No.: US 9,226,864 B2
(45) Date of Patent: Jan. 5, 2016

(54) ORTHOPEDIC REHAB TOILET SEAT

(76) Inventors: Charles Gianfagna, Albany, NY (US); Chitranjan Ranawat, Alpine, NJ (US)

( * ) Notice: Subject to any disclaimer, the term of this patent is extended or adjusted under 35 U.S.C. 154(b) by 390 days.

(21) Appl. No.: 13/485,457

(22) Filed: May 31, 2012

(65) Prior Publication Data

US 2012/0304370 A1 Dec. 6, 2012

Related U.S. Application Data

(60) Provisional application No. 61/491,468, filed on May 31, 2011.

(51) Int. Cl.
*A47K 13/00* (2006.01)
*A61G 7/10* (2006.01)

(52) U.S. Cl.
CPC ..... *A61G 7/1007* (2013.01)

(58) Field of Classification Search
CPC ..... A47K 11/04; A61G 5/14; A47C 9/002
USPC ..... 4/667, 480, 483, 237, 251; 297/313, 297/327, 328, 344.18
See application file for complete search history.

(56) References Cited

U.S. PATENT DOCUMENTS

| | | | | |
|---|---|---|---|---|
| 257,065 | A * | 4/1882 | Pursell | 297/383 |
| 3,360,297 | A * | 12/1967 | Oja et al. | 297/36 |
| 4,798,412 | A * | 1/1989 | Kohus et al. | 297/256.11 |
| 6,945,604 | B2 * | 9/2005 | Splane, Jr. | 297/313 |
| 2010/0154108 | A1 * | 6/2010 | Deutsch | 4/483 |

* cited by examiner

*Primary Examiner* — Huyen Le
*Assistant Examiner* — Christine Skubinna
(74) *Attorney, Agent, or Firm* — Heslin Rothenberg Farley & Mesiti P.C.

(57) ABSTRACT

An orthopedic toilet seat includes a frame supporting a seat. The frame is moveable over an existing toilet so that the seat is positioned to allow a person to use the toilet when sitting on the seat. The toilet seat may be configured so that the femur to spine, and femur to shin, joint angles are between 90° and 140°. Also, the seat is configured to be disposed at an angle between 5° and 65° above horizontal.

18 Claims, 9 Drawing Sheets

ORTHOPEDIC REHAB TOILET SEAT

CLAIM OF PRIORITY

This application claims priority to U.S. Provisional Application No. 61/491,468 filed May 31, 2011 and titled "Orthopedic Toilet Seat", which is incorporated herein by reference in its entirety.

TECHNICAL FIELD

This invention relates generally to the field of devices adapted for post-operative patients and more specifically, to the field of toilet seats adapted for use by post operative patients.

BACKGROUND OF THE INVENTION

An aging population has increased the number of knee and hip surgeries. Other medical advances have resulted in increased life spans, including post knee and hip replacement life spans. Despite many of the medical advances, patient mobility is significantly reduced after undergoing a hip or knee surgery. There are also precautions that need to be followed, status post hip replacement surgery, to insure that the new joint (hip implant) remains intact. The decrease in mobility includes reduced mobility while sitting. The reduction in mobility not only affects patients immediately following surgery, but may continue for substantial periods of time. The reduction in sitting mobility makes it difficult for patients to use every day toilets.

Custom-made toilets and toilet adaptive items are impractical and expensive. Simple booster seats make toilets easier to use as they effectively raise the level of the toilet seat, but are insufficient as knees and hips can still flex to an undesired degree. They are also very uncomfortable after surgery due to the expected swelling and pressure they place on their sides. More complex mechanical lifting devices have also been created, but can be expensive, difficult to install, and may still cause knees and hips to flex more than the desired amount. Both simple booster seats and complex mechanical lifting devices are not completely safe, as patients may slip off of them.

SUMMARY OF THE INVENTION

The present invention provides a progressive sequence of therapeutic postures (administered by a certified physical therapist) to improve the range of motion of a unilateral or bilateral total hip or total knee post operative patient enabling the patient, over time, to return to the normal toileting activities; specifically sitting on a horizontal (i.e., aka the 90° posture) toilet seat to defecate on a standard, manufactured water closet. This seat also provides for maximal comfort when toileting as it does not require a person to flex beyond their capabilities immediately postoperatively. It is adaptable to the rehab of post-operative lower back and spinal surgery patient as well. The frame of this orthopedic device is adjustable to accommodate a range of human scale (sizes/heights) and gender and is configured to support an adjustable seat. The frame is portable and therefore moveable to fit over standard manufactured size toilets (cantilevered or pedestal type), where this seat is positioned over the existing toilet to allow the person/patient to use the toilet when sitting on the seat. The seat is contoured and configured to be stably disposed at one or more angles above horizontal. The contoured orthopedic toilet seat may include a support disposed beneath seat, a support may be disposed at various heights, this seat rests against the support. This seat can be disposed at varying angles above the horizontal. The angles of inclination of this seat may be between 5° and 65° above horizontal. In some embodiments, the flexion of a user's hip or knee is less than 90 degrees and less than 40-45 degrees respectively. This seat contour predisposes the legs/thighs to conform to an anatomically correct and preferred position preventing internal rotation as well as adduction at the hip, thereby reducing the risk of hip joint dislocation or knee joint strain. It can be helpful in reducing spasticity and other related muscle tone affecting conditions.

The invention provides, in one aspect, an orthopedic toilet seat, including, a frame configured to support a seat, the seat configured to be stably disposed at one or more angles above the horizontal the frame being moveable over an existing toilet wherein the seat is positioned over the existing toilet to allow a person to use the toilet when stilling on the seat. In another embodiment, the orthopedic toilet seat also includes a back support couple to the frame, where the back support is oriented relative to the seat such that the angle between the femur and the spine of the person sitting on the seat and resting on the back support is between 110° and 120° and the angle between the femur and shin of the person sitting on the seat and resting on the back support is between 90° and 140°.

In one embodiment, the orthopedic toilet seat includes one or more slots formed in the frame, the one or more slots configured to receive and retain a support disposed inferior to the seat. In another embodiment, the seat of the orthopedic toilet seat is configured to be disposed at an angle between five degrees and sixty-five degrees above horizontal. In another embodiment, the seat of the orthopedic toilet seat is disposed at an angle thirty-five degrees above horizontal. In yet another embodiment, the seat of the orthopedic toilet seat is disposed at an angle forty-five degrees above horizontal. In another embodiment of the invention, the seat of the orthopedic toilet seat is disposed at an angle fifty-five degrees above horizontal. The entire unit is adjustable in height to accommodate various sizes, stature and gender.

In another embodiment of the invention, the seat of the orthopedic toilet seat is disposed at an angle such that a user's hip flexes less than ninety degrees. In one embodiment of the invention, the seat of the orthopedic toilet seat is disposed at an angle such that a user's hip flexes less than eighty degrees. In another embodiment of the invention, the seat of the orthopedic toilet seat is disposed at an angle such that a user's hip flexes less than seventy degrees. In still another embodiment of the invention, the seat of the orthopedic toilet seat is disposed at an angle such that a user's hip flexes less than sixty degrees.

In another embodiment of the orthopedic toilet seat, the seat is disposed at an angle such that a knee of a user flexes less than ninety degrees. In another embodiment, the seat is disposed at an angle such that a knee of a user flexes less than eighty degrees. In another embodiment, the seat is disposed at an angle such that a knee of a user flexes less than seventy degrees. In still another embodiment, the seat is disposed at an angle such that the knee of a user flexes less than sixty degrees.

In still another embodiment of the orthopedic toilet seat, one or more hand supports are formed on the frame, and the one or more hand supports are configured to support a user's weight.

Other additional features and benefits will become apparent from the following drawings and descriptions of the invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the end of the specification. The foregoing and other objects, features, and advantages of the invention are apparent from the following detailed description taken in conjunction with the accompanying drawings in which:

DETAILED DESCRIPTION FOR CARRYING OUT THE INVENTION

Figure 1:
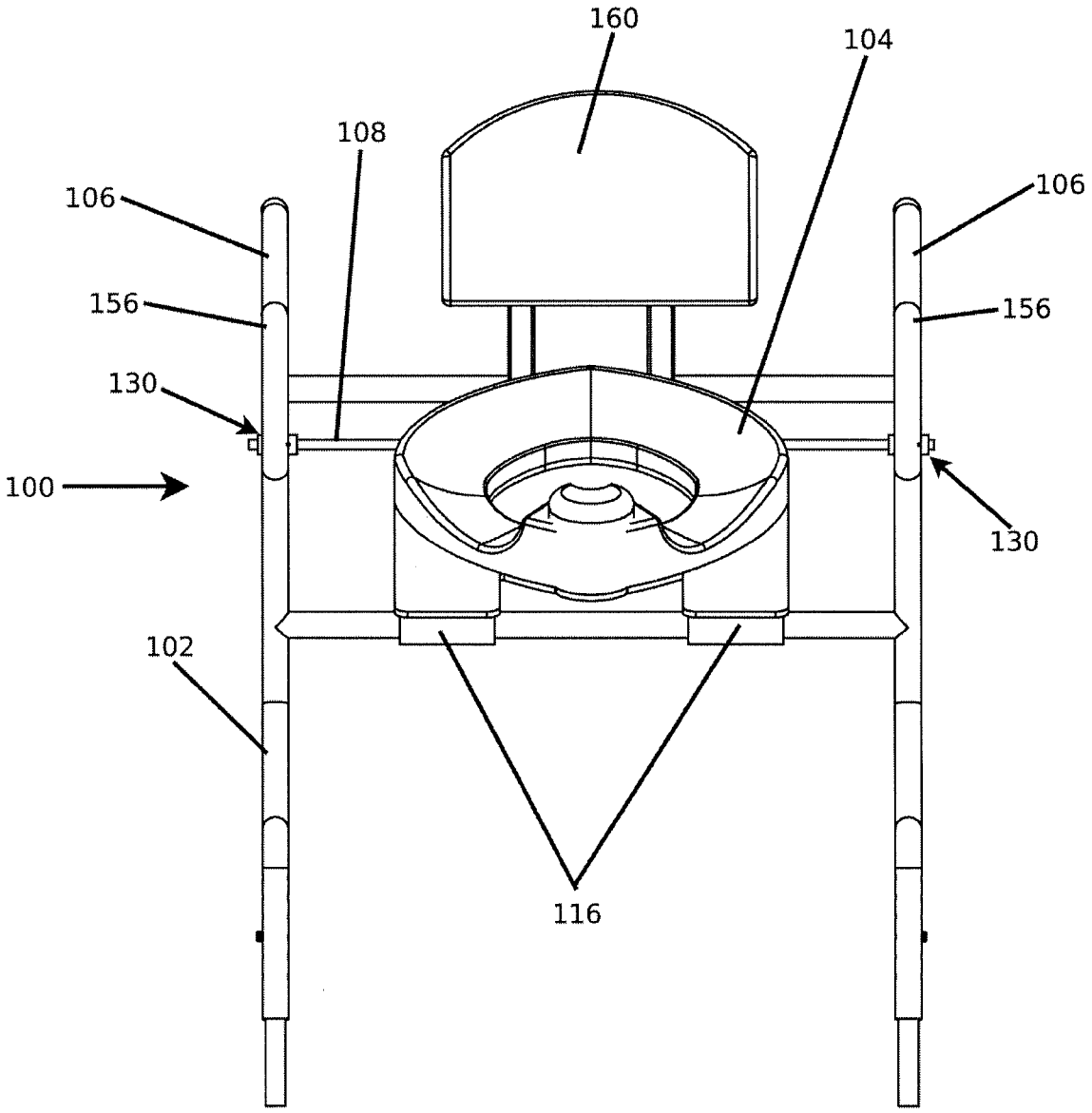
FIG. 1 is a front view of one embodiment of an orthopedic toilet seat, in accordance with an aspect of the invention.

For the purposes of promoting an understanding of the principles of the orthopedic toilet seat, reference will now be made to the embodiments, or examples, illustrated in the drawings and specific language will be used to describe these. It will nevertheless be understood that no limitation of the scope of the invention is thereby intended. Any alterations and further modifications in the described embodiments, and any further applications of the principles of the invention as described herein are contemplated as would normally occur to one skilled in the art to which the orthopedic toilet seat invention relates.

An embodiment of the orthopedic toilet seat of the invention is identified in FIGS. 1-8 by reference number 100.

Figure 2:
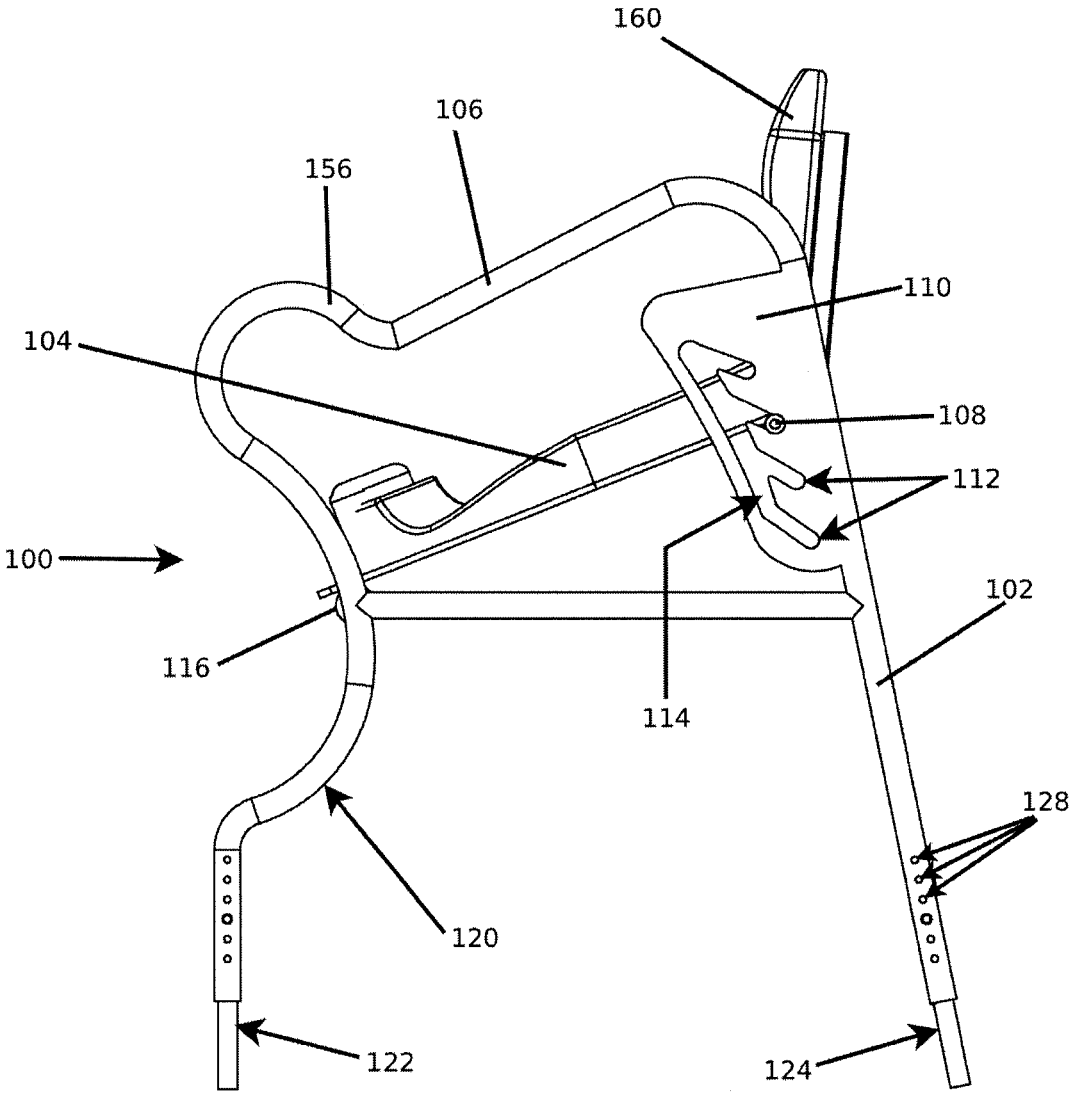
FIG. 2 is a side view of the orthopedic toilet seat of FIG. 1, in accordance with an aspect of the invention.

Referring to FIGS. 1 and 2, orthopedic toilet seat 100 may be comprised of a frame 102 and a seat 104. Frame 102 is configured to support seat 104. Frame 102 may include one or more arm supports 106. Seat 104 may be contoured to support the lumbar and sacral regions of the body. In one embodiment, seat 104 may be attached to frame 102 with a hinge. In another embodiment, seat 104 may be slideably mounted on frame 102. Seat 104 may be locked in place with a pin, screw, bolt, latch or other securing means known in the art.

In one embodiment of orthopedic toilet seat 100 is shown. In this embodiment orthopedic toilet seat 100 may be comprised of frame 102 and seat 104. One or more arm supports 106 may be formed in frame 102. A support 108 may be positioned beneath seat 104 such that a user may place weight on seat 104 without any movement of seat 104. One or more brackets 110 may be formed on frame 102. One or more slots 112 may be formed in brackets 110. One or more passage 114 may be formed in brackets 110 and connect one or more slots 112. A moveable support rod 108 may be placed within passages on both sides of orthopedic toilet seat 100, in brackets 110. A specific height for seat 104 may be selected by moving support 108 through passage 114 to one of the slots 112. If a different height or angle for seat 104 is required for a different user or as a user is permitted more hip and knee flexion through the recovery process, support 108 may be moved to a different slot 112 through passage 114 between uses.

In one embodiment, support 108 is not attached to seat 104. In this embodiment, seat 104 rests against support 108, a downward force applied by a user is resisted by the presence of support 108. In one alternative embodiment, support 108 is movably attached to seat 104. Support 108 may move along one or more rails or be guided through one or more apertures in one or more brackets formed underneath seat 104. In still another embodiment, support 108 may be permanently affixed to seat 104. In the embodiment where support 108 is permanently affixed to seat 104, seat 104 must be capable of movement relative to frame 102 at an alternative point.

Still referring to FIGS. 1 and 2, seat 104 may be attached to frame 102 with one or more hinges 116. In the embodiment shown hinges 116 freely allow rotational movement of toilet seat 104. Thus, support 108 may be easily be manipulated to be placed in any of the slots 112 and toilet seat 104 may be rotated so that it rests upon support 108. In alternative embodiments, hinge 116 may be a locking hinge configured to control the movement of seat 104. Where hinge 116 is a locking hinge, support 108 and one or more brackets 110 may be omitted from orthopedic toilet seat 100 provided hinge 116 is strong enough to support a user.

Figure 3:
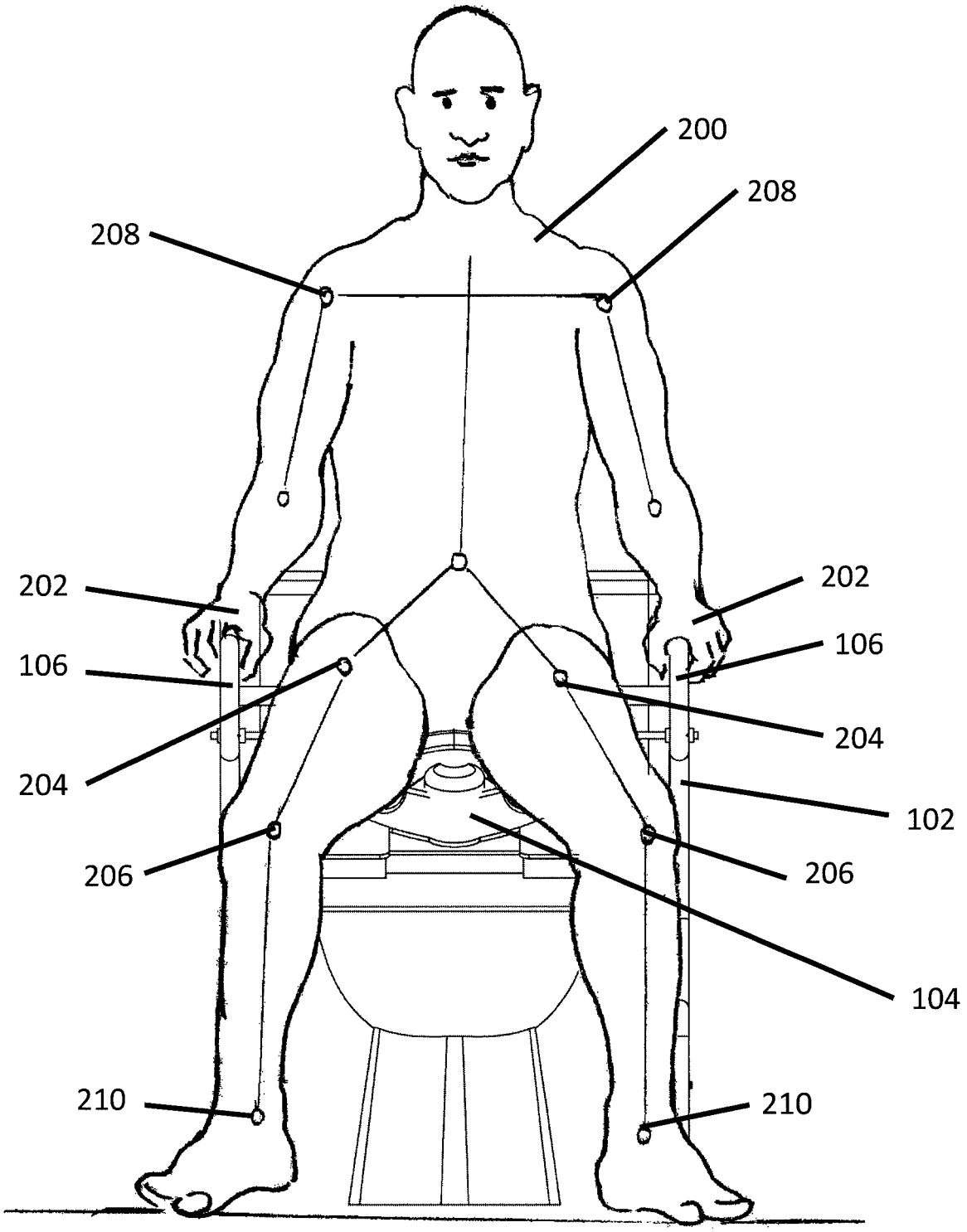
FIG. 3 depicts a front view of the orthopedic toilet seat of FIG. 1, where a user is seated in the orthopedic toilet seat, in accordance with an aspect of the invention.
Figure 4:
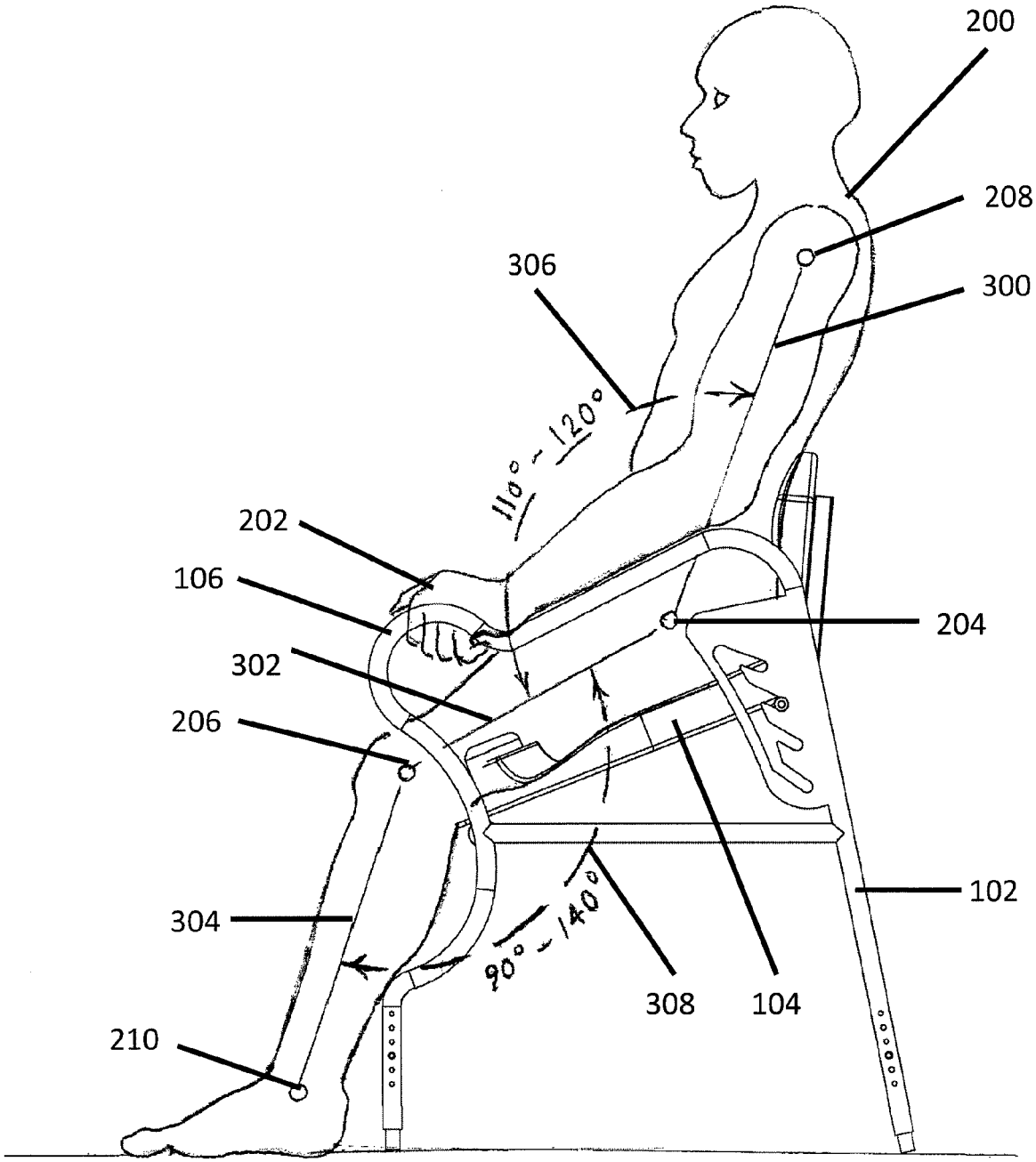
FIG. 4 depicts a side view of the orthopedic toilet seat of FIG. 1, where a user is seated in the orthopedic toilet seat, in accordance with an aspect of the invention.

Referring now to FIGS. 3 and 4, orthopedic toilet seat 100 is shown with a user 200 seated upon seat 104. The user 200 may place one or more hands 202 on one or more arm supports 106 in order to stabilize himself and prevent movement during use. User 200 may flex a hip 204 and/or a knee 206 in order to sit upon seat 104. In one embodiment, the flexion of hip 204 is less than ninety degrees from a standing position. In another aspect, the flexion of hip 204 is less than eighty degrees from a standing position. In still another aspect, the flexion of hip 204 is less than seventy degrees. In another aspect, the flexion of hip 204 is less than sixty degrees. In one aspect, the flexion of knee 206 from a standing position is less than ninety degrees. In another aspect, the flexion of knee 206 is less than eighty degrees. In yet another aspect, the flexion of knee 206 is less than seventy degrees. In still another aspect, the flexion of knee 206 is less than sixty degrees. In each of these aspects, seat 104 may be disposed at an angle which results in the desired amount of hip and/or knee flexion. After a patient has undergone a hip and/or knee surgery, it may be painful, damaging or otherwise undesirable for the hip and/or knee to be flexed beyond a certain degree. As the patient overcomes the surgery, it may be desirable to adjust the amount of hip and/or knee flexion that is possible during the use of the orthopedic toilet seat. As recovery progresses, it may be desirable to gradually enable to the user greater hip and/or knee flexion so that the user may ultimately use a standard toilet without aid.

Still referring to FIGS. 1 and 2, orthopedic toilet seat 100 may include a back support 160. The back support 160 is configured to support a user 200 when the user is seated upon seat 104. Now Referring to FIG. 4, when user 200 is seated upon seat 104, several angles are formed by the anatomy of the user 200. These angles are defined by lines connecting various portions of the user's anatomy. A spine dimension line 300 is formed between the center of a shoulder 208 and the center of the hip 204 and approximates the orientation of the spine of user 200. A femur dimension line 302 is formed between the center of the knee 206 and the center of the hip 204 and approximates the orientation of the femur of user 200. A shin dimension line 304 is formed between the center of the knee 206 and the center of an ankle 210 and approximates the orientation of a shin of user 200.

The angle 306 formed between spine dimension line 300 and femur dimension line 302 is approximately between 90° and 140°. Any angle between 90° and 140° is within the scope of this invention. In an alternative embodiment, angle 306 is approximately between 90° and 140°. Any angle between 90° and 140° is within the scope of this invention. The angle 308 formed between femur dimension line 302 and shin dimension line 304 is approximately between 90° and 140°. Any angle between 90° and 140° is within the scope of this invention. In an alternative embodiment angle 308 is approximately between 90° and 140°. It should be understood that the angles 306, 308 between the respective dimension lines are substantially equal to the angles between the patient's actual anatomy.

The proper angle of seat 104 may be achieved by adjusting the height of seat 104 relative to frame 102. Alternatively, the angle at which seat 104 is disposed may be changed by pivoting seat 104, or raising the front or rear of seat 104. In alternative embodiments, seat 104 may be at an angle that is between twenty-five and sixty-five degrees above horizontal, including but not limited to twenty-five, thirty-five, forty-five, fifty-five or sixty-five degrees above horizontal. In these embodiments, the rear portion of seat 104 is higher than the front portion of seat 104.

Figure 5:
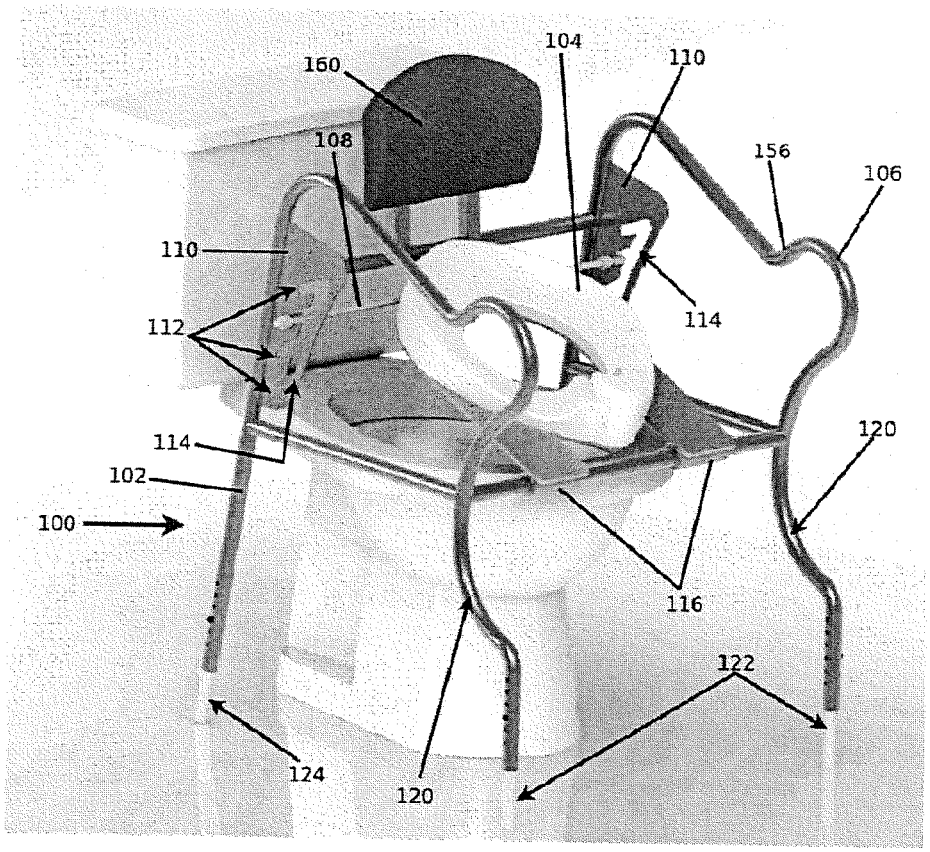
FIG. 5 is a perspective view of an alternative embodiment of the orthopedic toilet seat of FIG. 1, in relationship to a standard pedestal water closet, in accordance with an aspect of the invention.

Referring now to FIG. 5, in this embodiment, orthopedic toilet seat 100 demonstrates its portability and docking position over a standard pedestal water closet. It also docks over standard cantilevered, flushometer type water closets with similar ease.

Figure 6:
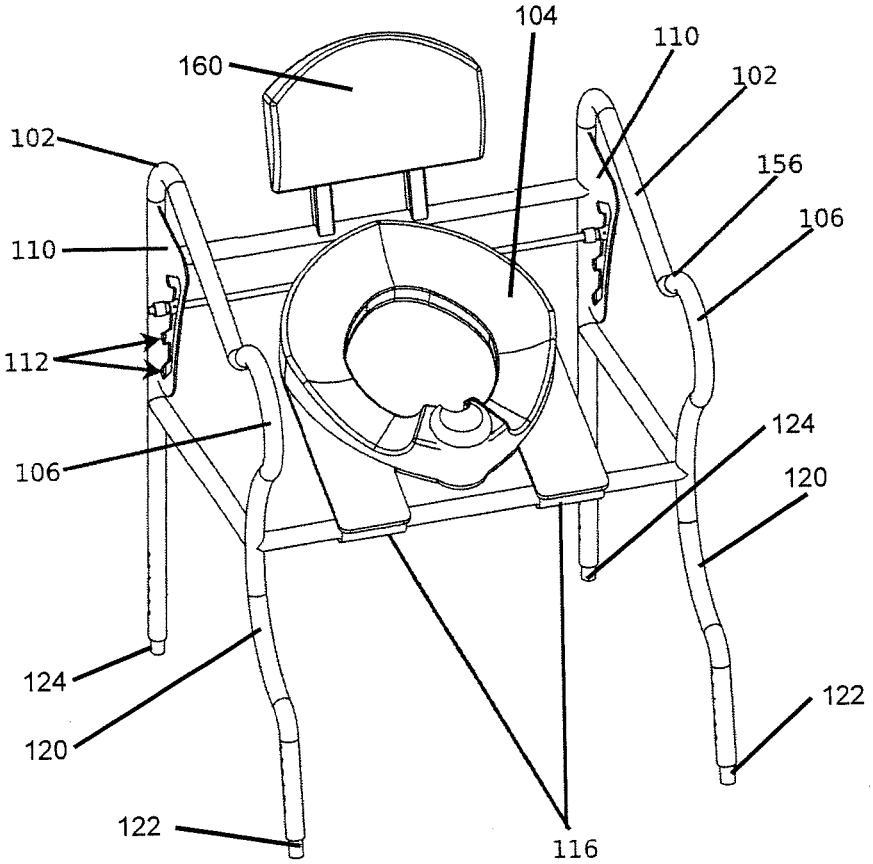
FIG. 6 is a perspective view of the frame and the unique contoured orthopedic toilet seat of FIG. 5, in accordance with an aspect of the invention.
Figure 7:
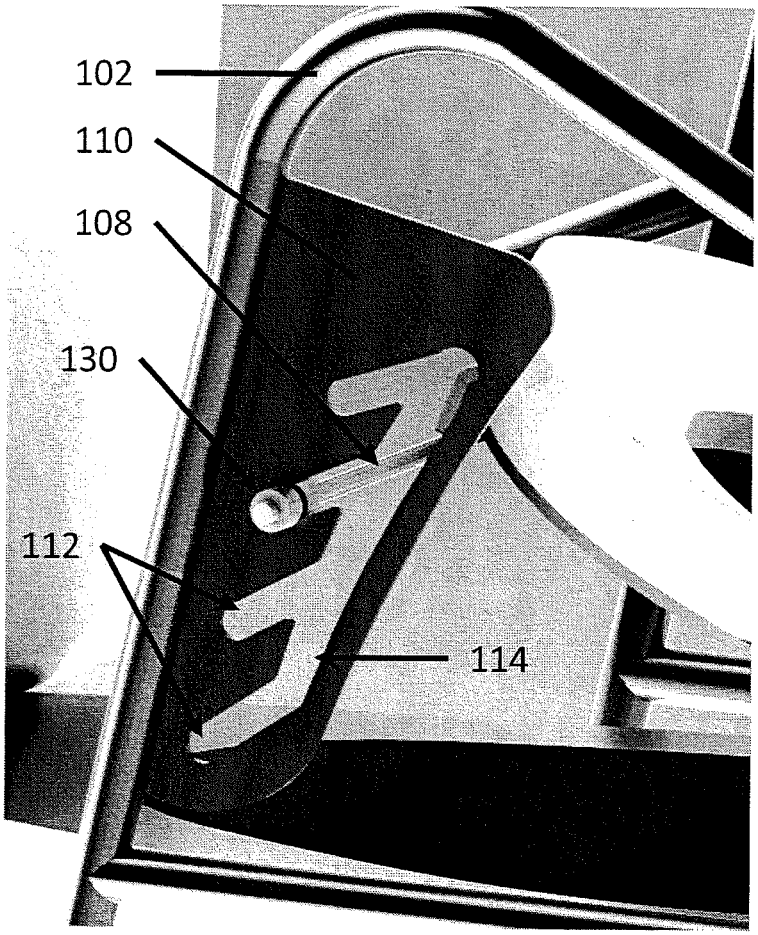
FIG. 7 is a detailed view of a bracket and seat angle adjustment slots formed on the frame of the orthopedic toilet seat of FIG. 5, in accordance with an aspect of the invention.

Referring now to FIG. 7, bracket 110 is shown in detail. Bracket 110 is shown permanently affixed to frame 102. Bracket 110 may be welded, glued, or otherwise mechanically fastened or permanently affixed to frame 102. Slots 112 are formed in bracket 110 and are in communication with passage 114. Slots 112 are disposed at an angle such that support 108, once placed in a particular slot 112, cannot unintentionally escape and undesired movement of support 108 is effectively eliminated. However, a user can easily move support 108 from one slot 112 to an alternative slot 112 through passage 114. Support 108 may include a guard 130 which prevents support 108 from unintentionally leaving bracket 110. In alternative embodiments, slots 112 may be formed on bracket 110 such that passage 114 is not included. In another alternative embodiment, slots 112 may be formed directly on frame 102 such that bracket 110 is unnecessary. In still another alternative embodiment, frame 102 may be formed such that slots 112 are unnecessary, and support 108 may rest directly against frame 102. Referring now to FIG. 6, frame 102 is shown and the water closet has been omitted for clarity. One or more arm support 106 is formed in frame 102 and extends to a height that is sufficient for a user to be supported, and fosters the desired amount of hip and/or knee flexion. In alternative embodiments, the height of arm support may vary for users of different heights. The dimensions of frame 102 may vary depending on the size and shape of the toilet that it is designed for. For example, frame 102 may include one or more bent sections 120, configured to bring seat 104 in proximity to a toilet bowl. One or more arm supports 106 may be substantially above one or more front feet 122 such that when a generally downward force is applied to one or more arm supports 106, the stability of orthopedic toilet seat 100 is not significantly affected.

Figure 8:
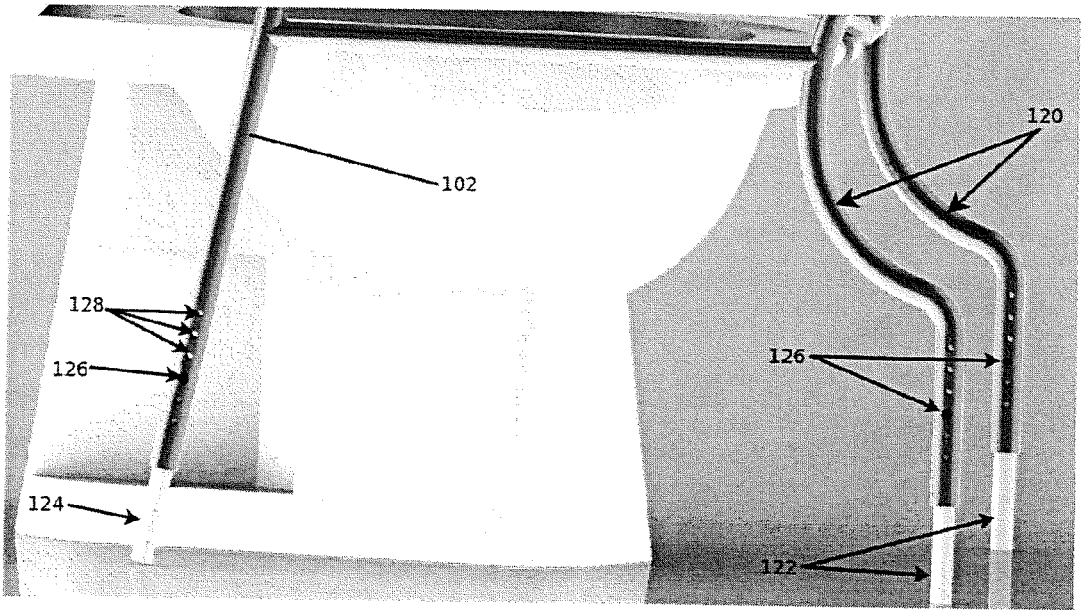
FIG. 8, is a detailed view of the bottom portion of the frame of the orthopedic toilet seat of FIG. 5, in accordance with an aspect of the invention.

Referring now to FIG. 8, the bottom of frame 102 is shown in detail. Front feet 122 may be movably attached beneath bent section 120. Alternatively, front feet 122 may be disposed beneath frame 102 without a bent section 120. One or more rear feet 124 may be movably attached to another portion of frame 102. Although the embodiments shown in FIGS. 5-8 show frame 102 with two front feet 122 and two rear feet 124, more or less feet may be movably attached to frame 102. Front feet 122 and rear feet 124 may each include one or more push-pull pin 126. One or more aperture 128 may be formed in frame 102 to receive push-pull pin 126. When push-pull pin 126 is depressed, front feet 122 or rear feet 124 may be adjusted to a different height, resulting in a change for the overall height of orthopedic toilet seat 100. In alternative embodiments, a quick release pin with a tether or other known means of movably affixing front feet 122 and rear feet 124 to frame 102 may be utilized in place of push pull pin 126. Push-pull pin and quick release pin are examples of coupling mechanisms. The height of orthopedic toilet seat 100 may accommodate toilets of different sizes, or may accommodate users of different sizes. In an alternative embodiment, the angle of seat 104 may be adjusted by setting front feet 122 to a different height than rear feet 124. However, this embodiment may be limited as adjusting front feet 122 and rear feet 124 to different heights may decrease the overall stability of orthopedic toilet seat 100, or may result in seat 104 not being properly centered over a toilet.

In the embodiments described above, frame 102 may be constructed from tubular stainless steel or aluminum. These materials are suitable because they can be easily formed into the desired shapes and are easy to clean. It should be understood that alternative materials with these properties are within the scope of the disclosure. Seat 104 may be made of a blow-molded plastic, or similar material. In some embodiments, a top surface of seat 104 may include padding, which may be foam, plastic or other material.

In alternative embodiments, arm supports 106 may include a section 156 which is formed to provide a cushion or gripping surface. Frame 102 may be hard or cold to the touch, a cushion at section 156 may be provided for the comfort of user 200. Frame 102 may also be smooth or slippery; section 156 may be covered with a grip, which may be plastic, rubber or other material. In an alternative embodiment, section 156 may have groves or be knurled to allow user 200 to grasp arm support 106 without slipping.

Each of the embodiments of orthopedic toilet seat 100 described herein are capable of being adapted to be used with various toilets. Orthopedic toilet seat 100 is also capable of being moved from one location to another to be used with a different toilet if necessary. Generally speaking the light weight and portability of frame 102 results in a very movable orthopedic toilet seat 100 that may be moved from use with a first toilet and be used with a second toilet. Orthopedic toilet seat 100 may be moved about a single room, be transferred to a different room within the same building, or may be transferred from a first building to a second building. The various embodiments described herein explain the manner in which orthopedic toilet seat may be adjusted to accommodate different toilet seats.

Figure 9:
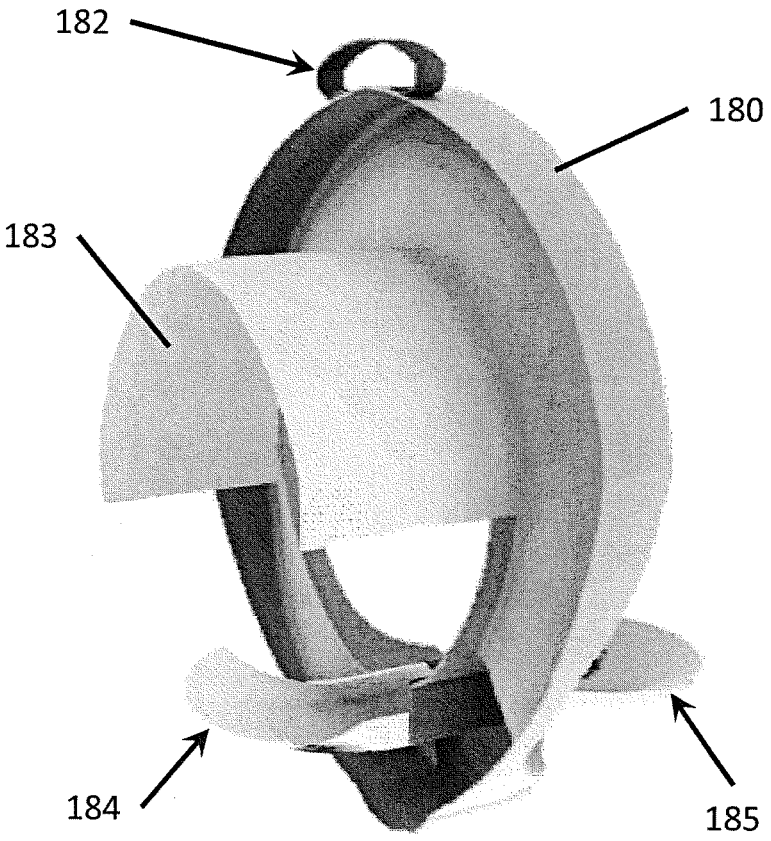
FIG. 9, is a detailed view of the underside of the seat illustrating the splash curtain and urine shield

Referring now to FIG. 9, in another embodiment, a removable, vacuum-formed cover 180 is used to easily keep the seat 104 clean. In this embodiment, vacuum-formed cover 180 may also be equipped with a webbed fabric handle 182 for sanitary handling and ease of removal. In one embodiment, removable cover 180 may be disposable.

Still referring to FIG. 9, another embodiment makes use of a removable splash curtain 183 which may be mounted on the underside of the seat 104 via flat recessed magnets, snap fits, friction fits, or other forms of mechanical attachment for ease of cleaning and disposal. In another embodiment, the splash curtain 183 is attached to removable cover 180. In yet another embodiment, the splash curtain 183 and removable cover 180 may be formed from the same piece of material for ease of removal and disposal. The purpose of the splash curtain is to restrict and re-direct the splatter of excrement resulting from loose bowel movements.

Still referring to FIG. 9, another embodiment makes use of a urine guard assembly, comprised of the urine shield 185, and the urine guide 184. Urine shield 185 is removable and is deployed primarily for male patients. Urine shield 185 contains and directs the trajectory of the urine stream, necessary due to the acute disposition of seat 104 in its various settings, therefore influencing the male patient's anatomical posture while sitting. Urine guide 184 further redirects urine stream redirected by urine shield 185. For female patients, urine guide 184 may also be used in the absence of urine shield 185. In this embodiment it is primarily used to redirect and contain potential splashing from urination while using a toilet at a difficult angle. Urine shield 185 and urine guide 184 may be fastened using friction fittings, snap fits, magnets, or other means of mechanical attachment. In one embodiment urine shield 185 and urine guide 184 may be attached to seat 104. In another embodiment urine shield 185 and urine guide 184 may be used in conjunction with and attached to removable cover 180. In yet another embodiment urine shield 185 and urine guide 184 could be made simultaneously out of the same piece of material as removable cover 180 and splash curtain 183, to be a single disposable piece. In yet another embodiment urine guide 184 could be made simultaneously out of the same piece of material as removable cover 180 and splash curtain 183, to be a single disposable piece. In the above embodiment, urine shield 185 may be removable addition to removable cover 180.

While embodiments of the invention have been illustrated and described in detail in the disclosure, the disclosure is to be considered as illustrative and not restrictive in character. All changes and modifications that come within the spirit of the invention are to be considered within the scope of the disclosure.

The invention claimed is:

1. An orthopedic toilet seat, comprising:

a frame configured to support a seat;

a seat operatively engaged to said frame and configured to be stably disposed at one of a plurality of predefined angles above horizontal with a rear portion of the seat positioned higher than a front portion of the seat and upward angulation of the seat from said angle above horizontal is inhibited when a person sits on the seat; and the frame being moveable over an existing toilet such that the seat is positioned over the existing toilet and is configured to allow said person to use the toilet when sitting on the seat.

2. The orthopedic toilet seat of claim 1, further comprising:

a back support coupled to the frame being oriented relative to the seat.

3. The orthopedic toilet seat of claim 1, wherein one or more slots are formed in the frame, the one or more slots configured to receive and retain a brace that is positioned inferior to the seat to stably dispose said seat at one of the plurality of predefined angles above horizontal.

4. The orthopedic toilet seat of claim 1, wherein the seat is configured to be disposed at an angle between five degrees and sixty-five degrees above horizontal.

5. The orthopedic toilet seat of claim 4, wherein the seat is configured to be disposed at an angle between five degrees and fifty-five degrees above horizontal.

6. The orthopedic toilet seat of claim 1, wherein the seat is configured to be disposed at an angle between ten degrees and forty-five degrees above horizontal.

7. The orthopedic toilet seat of claim 1, wherein the seat is configured to be disposed at an angle between fifteen degrees and fifty-five degrees above horizontal.

8. The orthopedic toilet seat of claim 6, further comprising a back support coupled to the frame being oriented relative to the seat.

9. The orthopedic toilet seat of claim 1, wherein the frame further comprises:

one or more feet, configured to support the frame, and a coupling mechanism, configured to couple the one or more feet to one or more portions of the frame.

10. The orthopedic toilet seat of claim 1, wherein:

one or more hand supports are formed on the frame, the one or more hand supports configured to support a user's weight.

11. The orthopedic toilet seat of claim 4, further comprising:

a back support coupled to the frame being oriented relative to the seat.

12. The orthopedic toilet seat of claim 1, further comprising a back support coupled to the frame, and wherein the rear portion of the seat is proximate to the back support and the front portion of the seat is distal to the back support.

13. The orthopedic toilet seat of claim 1, wherein a plurality of slots are formed in the frame corresponding to the plurality of predefined angles above horizontal, the plurality of slots configured to receive and retain a brace that is positioned inferior to the seat to stably dispose said seat at one of the plurality of predefined angles above horizontal when a person sits on the seat.

14. The orthopedic toilet seat of claim 1, wherein the seat is configured to inhibit upward angulation of the seat from the angle above horizontal.

15. The orthopedic toilet seat of claim 1, wherein the seat is configured to provide for upward angulation of the seat from the one of a plurality of predefined angles above horizontal.

16. The orthopedic toilet seat of claim 15, wherein the weight of the person sitting on the seat inhibits upward angulation of the seat from the one of a plurality of predefined angles above horizontal.

17. The orthopedic toilet seat of claim 1, wherein the weight of the person sitting on the seat inhibits upward angulation of the seat from the one of a plurality of predefined angles above horizontal.

18. The orthopedic toilet seat of claim 1, wherein the seat is configured to be fixedly disposed at the one of a plurality of predefined angles above horizontal.

* * * * *